United States Patent [19]

Leinfelt

[11] 4,257,789

[45] Mar. 24, 1981

[54] COMBINATION VACUUM CLEANER AND DUST CONTAINER

[75] Inventor: Karl E. Leinfelt, Stockholm, Sweden

[73] Assignee: Aktiebolaget Electrolux, Stockholm, Sweden

[21] Appl. No.: 46,305

[22] Filed: Jun. 7, 1979

[30] Foreign Application Priority Data

Jun. 12, 1978 [SE] Sweden ..... 7806770

[51] Int. Cl.[3] ..... B01D 46/02; A47L 9/14

[52] U.S. Cl. ..... 55/378; 55/381; 55/491; 55/493; 55/502; 55/DIG. 2; 55/DIG. 3; 15/350

[58] Field of Search ..... 55/369, 373, 374, 378, 55/381, 491, 493, 502, 506, DIG. 2, DIG. 3, 361; 15/344, 347, 350; 229/53

[56] References Cited

U.S. PATENT DOCUMENTS

| | | | |
|---|---|---|---|
| 2,034,373 | 3/1936 | Bilde | 55/502 |
| 2,316,674 | 4/1943 | Dowe et al. | 55/373 |
| 2,336,584 | 12/1943 | Andrew | 55/DIG. 2 |

FOREIGN PATENT DOCUMENTS

| | | | |
|---|---|---|---|
| 1095480 | 6/1961 | Fed. Rep. of Germany | 55/DIG. 2 |

*Primary Examiner*—David L. Lacey
*Attorney, Agent, or Firm*—Alfred E. Miller

[57] ABSTRACT

The combination of a vacuum cleaner and a dust filter container. The dust filter container does not have a conventional attachment plate. A support structure is located in the vacuum cleaner housing having a projecting member provided with a hole, the latter is inserted through a slot in the dust container whereby the hole aligns with an opening in the dust container. The hole in the projecting member and the opening form a through passage into the dust container from the inlet suction conduit of the vacuum cleaner. A seal is arranged in the vacuum cleaner housing between a flange on the suction conduit and a portion of the dust filter container surrounding the hole therein.

7 Claims, 3 Drawing Figures

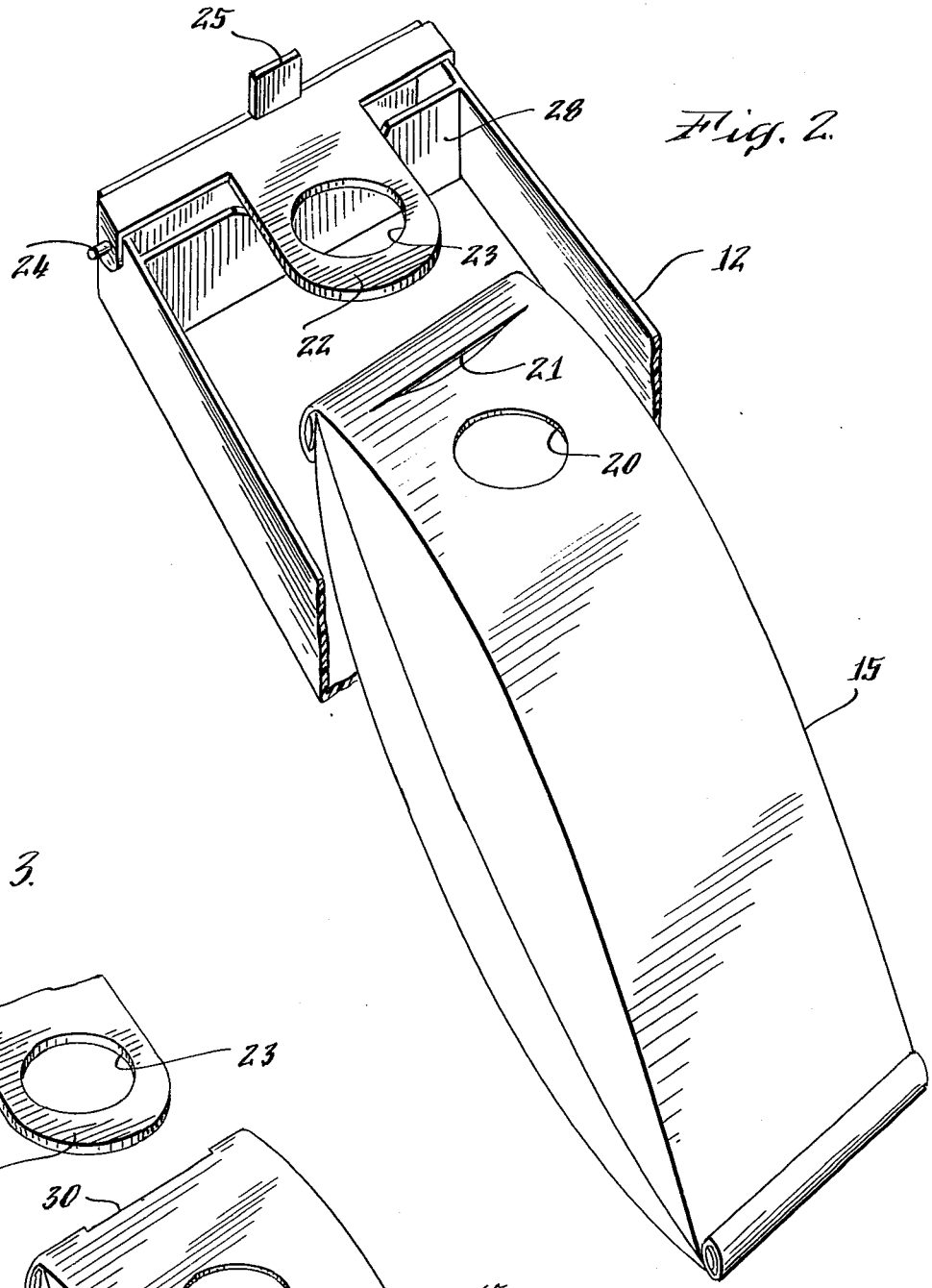
Fig. 2.
Fig. 3.
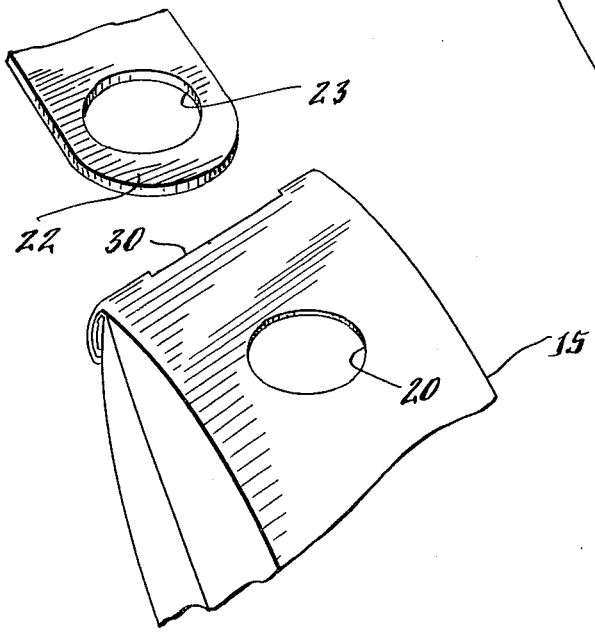

COMBINATION VACUUM CLEANER AND DUST CONTAINER

BACKGROUND OF THE INVENTION

It is well known to provide vacuum cleaners with dust bags or dust containers consisting of an air pervious portion connected to an attachment plate, made of cardboard or similar material, having an inlet opening for dust-laden air, the peripheral parts of said plate forming a supporting surface for the dust container when the dust container is inserted inside the vacuum cleaner.

It should be evident that the attachment plate increases the cost of the dust container due to increased material and working costs. Moreover, weight per unit is increased, resulting in increased transport charges.

This invention relates to a combination of a vacuum cleaner and a dust container wherein the latter comprises an air pervious portion with an opening for introducing of a suction conduit through which dust-laden air flows into the dust container.

An object of the present invention is to eliminate the above drawbacks of prior art constructions and to obtain a simple dust container, which is inexpensive to manufacture, small in weight, and is easy to use. For this purpose the invention is characterized in that a plate is introduced in the dust container into sealing contact with a sealing member arranged on the suction conduit, with the filtering portion of the dust container in its place between the plate and the sealing member.

In order that the invention will be more clearly understood, it will now be disclosed in greater detail with reference to the accompanying drawings, wherein:

FIG. 2 is a perspective view of the arrangement shown in FIG. 1; and

FIG. 3 is a fragmentary perspective view of a dust container showing another embodiment of the present invention.

DESCRIPTION OF THE PREFERRED EMBODIMENTS

Figure 1:
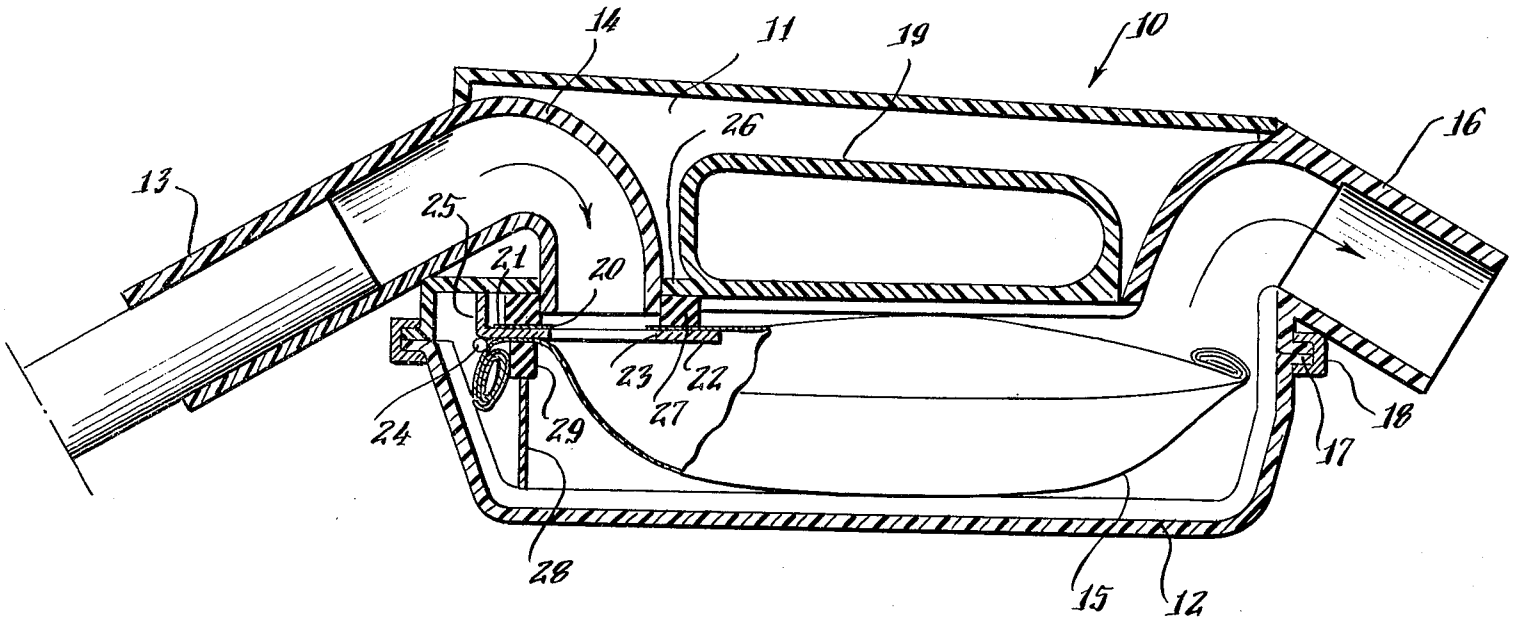
FIG. 1 is a cross section through part of a vacuum cleaner apparatus provided with a dust container or dust bag constructed in accordance with the teachings of the present invention.

FIG. 1 is a section of a separable vacuum cleaner housing 10, consisting of an upper casing portion 11 and a lower casing portion 12. Through an inlet conduit 13 of the vacuum cleaner apparatus the dust-laden air is conveyed from a vacuum cleaning nozzle (not shown) through a bend 14 in the conduit to the lower casing portion 12 in which a dust container 15 is arranged. Air passes through the filtering portion of the dust container 15 and is freed from dust particles in the dust container while pure air leaves the lower casing portion 12 through an outlet conduit 16, and is drawn in by vacuum into a motor fan unit (not shown).

The casing portions 11 and 12 are connected to each other by means of an outwardly protruding flanges 17 around which a sealing member 18 is arranged. The upper casing portion 11 is provided with a handle 19 by which the vacuum cleaner 10 is easily transported and the nozzle (not shown) connected to the conduit 13 is moved along a work surface for picking up dust and dirt.

Instead of using in a conventional manner a dust container in the vacuum cleaner which is provided with a stiff attachment plate for locating and sealing of the dust container inside the vacuum cleaner, the dust container, according to the invention, is closed on both its ends, and has in one of its side surfaces a generally circular opening 20. Moreover, a slot 21 is located in the dust container 15 for introducing a plate 22 therein. In addition, the plate 22 has a circular opening 23, the diameter of which is at least as large as the diameter of the opening 20. Thus, the plate 22 is attached to the vacuum cleaner 10, and is preferably swingably mounted thereon by means of a hinge 24.

A vertical grip surface 25 on the lower casing portion 12 enables the counterclockwise swinging of the plate 22 and at the same time prevents its clockwise movement from a horizontal position inside the portion 12. The conduit bend 14 has an integral flange 26 against which a packing 27 is arranged under the flange. A vertical wall 28 arranged inside the lower casing portion 12 between hinge 24 and the inlet opening of the plate 22, lies with its upper end through a sealing means 29 against the underside of the plate 22 so that the dust container 15 only through inlet and outlet conduits 13 and 16 respectively communicates with the outside of the dust container. Simultaneously, the wall 28 locates the plate 22 in its horizontal position.

When inserting the dust container in the vacuum cleaner housing, the plate 22 is introduced through the slot 21 and the plate then projects into the inner space of the dust container so that the inlet openings 20 and 23 of the plate 22 and the dust container 15 respectively coincide, and the slot 21 is located between the hinge 24 and the vertical wall 28. When the casing portions 11 and 12 are closed together, the packing 27 presses against the adjacent surface of the dust container 15 situated between the packing and the plate 22, and in this way, an efficient seal between the hose 13 and the dust container 15 is achieved. When the dust container is filled, the upper casing portion 11 is removed and the plate 22 by means of the grip surface 25 is swung somewhat counterclockwise out of the lower casing portion 12, which facilitates the removal of the dust container. Thereafter, a new dust container can be inserted in the vacuum cleaner.

The above-described embodiments are not intended to limit the invention to any extent. Thus, several modifications are possible within the scope of the claims, for example, the slot 21 can be eliminated, and the plate 22 introduced through an open end 30 of the dust container 15, as seen in FIG. 3.

What is claimed is:

1. A combination of a vacuum cleaner having a housing with a suction conduit entering therein and a dust filter container comprising: a support structure in said housing having a projecting member being provided with a hole, an opening in said dust filter container which is adapted to communicate with said suction conduit when said dust container is inserted in said vacuum cleaner housing and on said support structure, a slot in said dust filter container adjacent to said opening, an annular flange on the interior end of suction conduit, a seal arranged in said housing between said annular flange and a portion of said dust filter container surrounding said hole, and said projecting member is inserted through said slot in the dust container such that said hole is aligned with the opening in said dust filter container and whereby said seal is compressed between said annular flange and said portion of the dust filter container.

2. The combination as claimed in claim 1 wherein said member is a plate.

3. The combination as claimed in claim 2 wherein the hole in said plate is circular and has a diameter which is at least as large as the diameter of the opening.

4. The combination as claimed in claim 2 further including means for swingably mounting said structure and said projecting plate.

5. The combination as claimed in claim 1 wherein said dust container is closed at both ends and wherein said slot is located in one of the side walls of said dust container for the insertion therethrough of said projecting member into the interior of said dust container.

6. The combination as claimed in claim 5 further comprising a wall positioned within said support structure and said wall is substantially vertically arranged relative to the plane of said projecting member seal means positioned between said projecting member and the upper portion of said wall.

7. A combination of a vacuum cleaner and a dust filter container, said housing being bipartite and having a suction conduit entering into the top portion thereof and having an annular flange at the interior end thereof, and said dust filter container being positioned in the lower portion thereof and said combination comprising: a projecting plate having a hole being pivotally attached to said lower housing, an opening in said dust filter container which is adapted to communicate with said suction conduit when said dust filter container is inserted in said vacuum cleaner housing, a slot in said dust filter container adjacent to said opening, a seal arranged in said housing between said annular flange and a part of said dust filter container surrounding said opening, and said projecting plate is inserted in said slot in the dust container such that said hole is aligned with the opening in said dust filter container and whereby said seal is compressed between said annular flange and said part of the dust filter container.

* * * * *